US009518390B1

(12) United States Patent
Chao

(10) Patent No.: US 9,518,390 B1
(45) Date of Patent: Dec. 13, 2016

(54) SELF PROPELLED BLOWER

(71) Applicant: Albert Chao, Saddle River, NJ (US)

(72) Inventor: Albert Chao, Saddle River, NJ (US)

( * ) Notice: Subject to any disclaimer, the term of this patent is extended or adjusted under 35 U.S.C. 154(b) by 0 days.

(21) Appl. No.: 14/988,383

(22) Filed: Jan. 5, 2016

(51) Int. Cl.

| | |
|---|---|
| ***A47L 5/38*** | (2006.01) |
| ***E04D 13/076*** | (2006.01) |
| *A47L 5/14* | (2006.01) |
| *B08B 5/02* | (2006.01) |

(52) U.S. Cl.
CPC ..... *E04D 13/0765* (2013.01); *A47L 5/14* (2013.01); *A47L 5/38* (2013.01); *B08B 5/02* (2013.01)

(58) Field of Classification Search
CPC ..... A47L 5/38; A47L 5/14; E01D 13/0765; B08B 5/02
See application file for complete search history.

(56) References Cited

U.S. PATENT DOCUMENTS

| | | | | |
|---|---|---|---|---|
| 3,800,358 | A * | 4/1974 | Ryan | B08B 9/035 15/104.05 |
| 3,971,098 | A | 7/1976 | Davis | |
| 4,349,039 | A | 9/1982 | Egger | |
| 4,402,106 | A | 9/1983 | Mattson | |
| 4,502,806 | A | 3/1985 | Albertson | |
| 4,634,312 | A | 1/1987 | Sterzel | |
| 5,056,187 | A | 10/1991 | Higgins | |
| 5,195,209 | A | 3/1993 | Watkins | |
| 5,311,641 | A * | 5/1994 | Matsuura | B08B 5/02 15/104.05 |
| 5,528,789 | A * | 6/1996 | Rostamo | B08B 9/051 15/104.09 |
| 6,519,809 | B2 | 2/2003 | Gutry | |
| 6,766,560 | B2 | 7/2004 | Murphy | |
| 6,926,210 | B2 | 8/2005 | Baxter | |
| 7,549,191 | B2 | 6/2009 | Seasholtz et al. | |
| 8,739,362 | B1 | 6/2014 | Conder | |
| 9,074,374 | B1 | 7/2015 | Chao | |
| 9,175,477 | B1 | 11/2015 | Chao | |
| 2004/0143931 | A1 | 7/2004 | Dennis | |
| 2006/0236491 | A1* | 10/2006 | Baek | A47L 5/14 15/319 |
| 2008/0012310 | A1* | 1/2008 | Weaver | B08B 9/049 285/288.1 |

FOREIGN PATENT DOCUMENTS

| | | |
|---|---|---|
| WO | WO2014193103 | * 12/2014 |

* cited by examiner

*Primary Examiner* — David Redding
(74) *Attorney, Agent, or Firm* — Notaro, Michalos & Zaccaria P.C.

(57) ABSTRACT

A self propelled blower cleans debris from a gutter and has a housing with rear inlet and front outlet, an electrically powered air mover for moving air into the inlet and blowing it out of the outlet, a guide track laying along a channel of the gutter, an electrically powered housing mover engaged to the track for moving the housing along the guide track and a power circuit electrically connected to the air and housing movers for powering them at the same time to blow air forwardly along the gutter as the housing moves forwardly along the gutter.

18 Claims, 5 Drawing Sheets

SELF PROPELLED BLOWER

FIELD AND BACKGROUND OF THE INVENTION

The present invention relates generally to the field of house cleaning and maintenance, and in particular to a new and useful self propelled blower apparatus that can effectively remove leaves and other debris from building gutters.

It is known to use blowers to remove leaves from lawns. Since this is done at ground level, there is no issue of danger or access to the area to be cleaned. While a blower may be effective to remove leaves and debris from gutters, a ladder and long power cord would be needed for electric blowers, and using heavier gas powered blowers would be awkward and potentially dangerous to use high off the ground.

In order to take advantage of leaf blowers to clean gutters, several approaches are known for using long air containing conduits from the blower at ground level up to a guide or other air directing mechanism at the gutter level. See for example, the following: U.S. Pat. No. 3,971,098 for Gutter Cleaning Nozzle; U.S. Pat. No. 4,349,039 for Home Roof Gutter Sweep; U.S. Pat. No. 4,402,106 for Blower Attachment for Cleaning Rain Gutters; U.S. Pat. No. 4,502,806 for Gutter Cleaning Device; U.S. Pat. No. 4,634,312 for Self Cleaning Drain Gutter or Pipe; U.S. Pat. No. 5,056,187 for Eave Trough Cleaning Apparatus; U.S. Pat. No. 5,195,209 for Gutter Cleaning System; U.S. Pat. No. 6,519,809 for Gutter Cleaner; U.S. Pat. No. 6,766,560 for Gutter Leaf-Blower; U.S. Pat. No. 6,926,210 for System for Maintaining Gutter Debris Free; U.S. Pat. No. 7,549,191 for Gutter Cleaning Blower Vacuum Attachment Apparatus; U.S. Pat. No. 8,739,362 for Gutter Cleaning Attachment for a Leaf Blower; U.S. published patent application US 2004/0143931 for Gutter Cleaning System.

It is also known to use water jets to clean gutters. Since gutters are usually one, two or sometimes three stories off the ground, long spray wands are needed for gutters that are closer to the ground, and ladders must be used for higher gutters. Also, if the spray of water is not immediately effective to the remove the leaves and other debris from the gutters, the leaves and debris get wet, heavy and sticky and therefor become more difficult to remove.

The inventor of the invention disclosed here has also invented a Gutter Cleaning Apparatus disclosed in U.S. Pat. No. 9,074,374 which includes a channel with a water and air permeable platform for mounting in a gutter and an air flow guide engaged to an end of the channel and platform for directing air flow from a blower under and over the platform to lift and remove debris from an upper surface of the platform.

This inventor has also invented the Gutter Cleaning Apparatus of U.S. Pat. No. 9,175,477 which cleans debris from a gutter by including a platform with a plurality of spaced apart apertures each including a guide flap extending at an inclined air flow directing angle from under the platform for more effectively directing cleansing air flow from a blower to lift and remove debris from an upper surface of the platform.

A need remains for an even more effective way to clean household gutters using a blower.

SUMMARY OF THE INVENTION

It is an object of the present invention to provide a gutter cleaning apparatus that uses a blower to clean leaves and debris, collectively here called debris, from the gutters of a house or other building, collectively here called a building.

Accordingly, another object of the invention is to provide a self propelled blower apparatus for cleaning debris from a gutter having a concave channel for collecting and guiding water from a roof of a building, the apparatus including a housing with a rear inlet and a front outlet, an electrically powered air mover for moving air into the inlet and blowing it out of the outlet, a guide track laying along the channel, an electrically powered housing mover engaged to the track for moving the housing along the guide track, and a power circuit electrically connected to the air and housing movers for powering them at the same time to blow air forwardly along the gutter as the housing moves forwardly along the gutter.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 4:
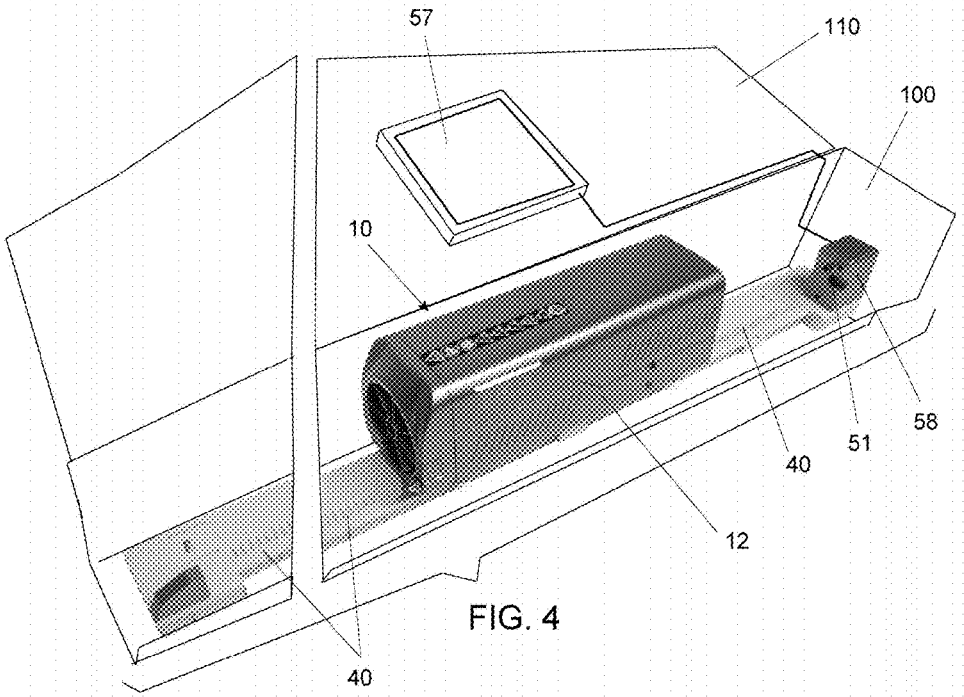
FIG. 4 is view similar to FIG. 1 of the apparatus of the invention in a building gutter channel.

Referring now to the drawings, in which like reference numerals are used to refer to the same or similar elements, FIG. 4 shows the self propelled gutter cleaning apparatus of the invention for cleaning debris from a building gutter having a concave channel 100 that collects and guides water from a roof 110 of a building.

As illustrated in FIGS. 1-4, the apparatus includes a blower 10 having a housing 12 having a rear wall 14 with a rear air inlet opening **14*a* and a front wall 16 with front air outlet opening 16*a*. An electrically powered air mover 20 is mounted in the housing 12 for moving air into the housing through the rear air inlet opening 14*a* and for blowing the air out of the housing through the front air outlet opening 16*a*** when it is powered.

a guide track 40 is placed along the floor of gutter channel 100 and an electrically powered housing mover 30 also mounted in the housing, is engaged to the guide track for moving the housing 12 along the guide track when powered. A power circuit 50 is electrically connected to the air mover 20 and the housing mover 30, for powering the air and housing movers at the same time to blow air forwardly along the gutter as the housing moves forwardly along the gutter.

The power circuit 50 includes a rechargeable battery 52 and a recharge and control circuit board 54 that can be activated by a remote control unit 56 that sends start and stop signals via radio waves to an antenna 55 connected to the circuit board. This way, after the apparatus has been installed, it can be controlled from the ground. Solar powered photovoltaic cell or cells 57, connected to a power station 58 at one end of the track 40, recharge the battery 52 when the blower housing 10 has returned to its starting position and has automatically plugged its female power coupler 59 into a mating male charge coupler 51 mounted at the power station 58. Electrical power from cell or cells 57 is supplied to the power station 58 by wire to a plug that is plugged into a power intake receptacle 58*b* at a rear wall of the power station.

The power circuit also includes a master power on/off switch 53, a stopping micro-switch 61 and a returning micro-switch 63 whose operation will be explained later in this disclosure.

The apparatus of the invention has been found to effectively blow leaves and other debris out of the gutter without the user having to climb up to the gutter.

The guide track 40 comprises multiple plastic molded track sections that are each one to two feet long for easy packaging for sale, and that are click-locked together, end-to-end until a desired total length of guide track 40 is achieved to service a length of gutter. A power section 42 that carries the power station 58 that is fixed to this section, is click-locked to the rear end of the track and a stop section 44 that has a stop 45 fixed to it, is click-locked to the front end of the track.

The click-lock connections best shown in FIGS. 6-9 are achieved by providing locking tongues 46 at one end of a section that locks into a mating groove 48 in a mating end of another section. To insure that the sections lock to each other in a reversible way, each tongue has a tab 46*a* on a flexible arm of the tongue 46, that locks into a mating slot 48*a* in the groove 48 of a section to be connected. A finger nail of tool can be used to push the tab down to allow the sections to be pulled apart if desired.

Figure 8:
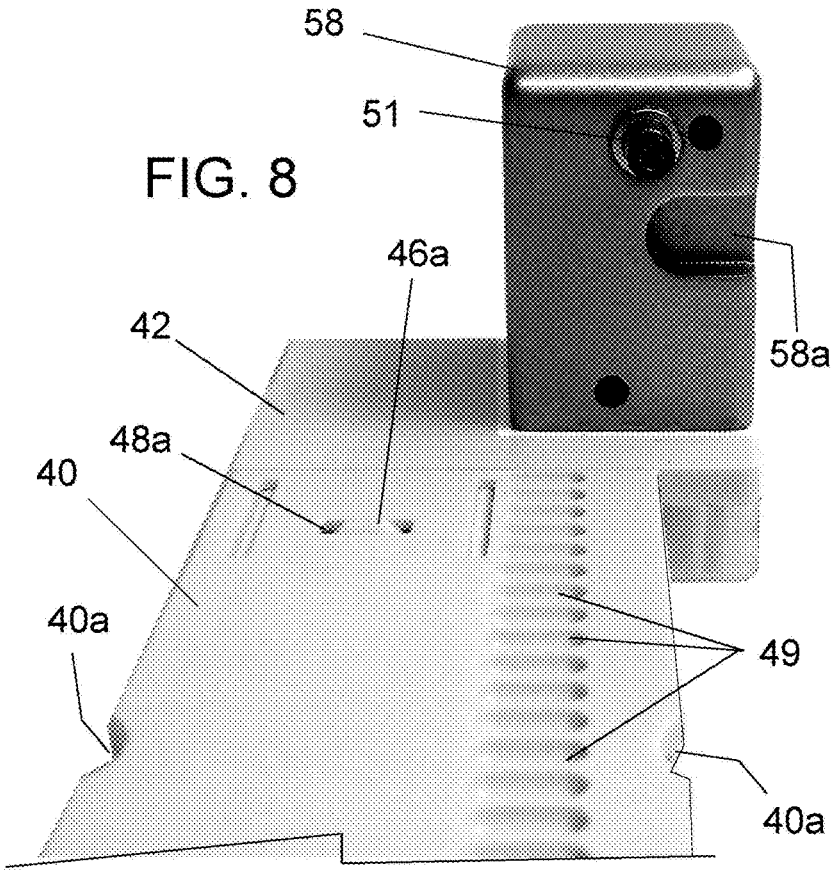
FIG. 8 is a view similar to FIG. 6 but with a track section attached to the power section and partially shown.
Figure 9:
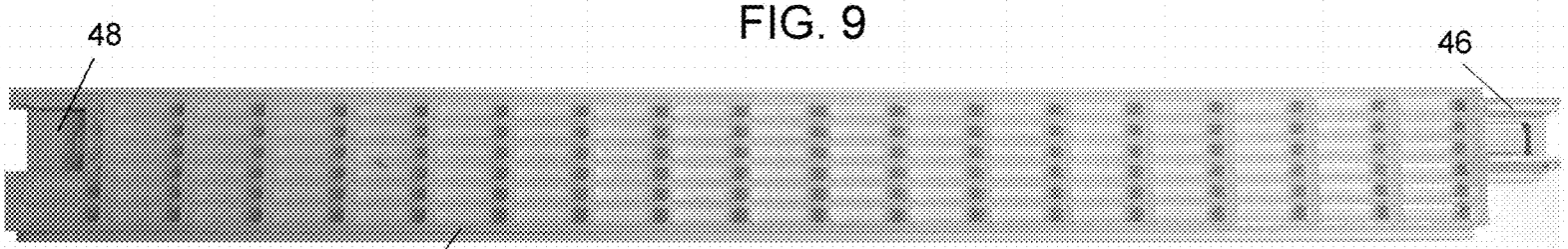
FIG. 9 is bottom plan view of a track section of the invention.
Figure 10:
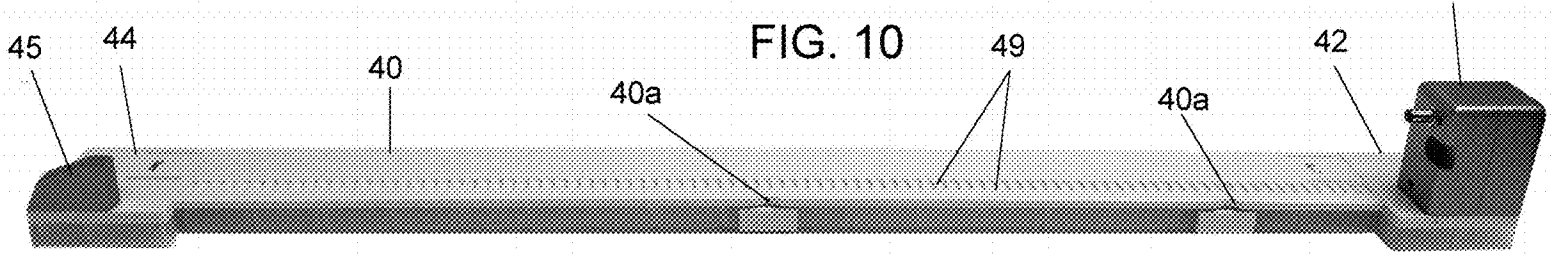
FIG. 10 is side perspective view of a the track section designed to receive the blower of the invention and to which the power and stop sections are also attached.

As also shown in FIG. 9, the bottom of each track section has a grate of strengthening ribs and as shown in FIGS. 8 and 10, the top of each section has a row of recessed teeth 49 that are engaged by the cogs of a cog wheel of the blower, for propelling the blower along the guide track 40.

Figure 1:
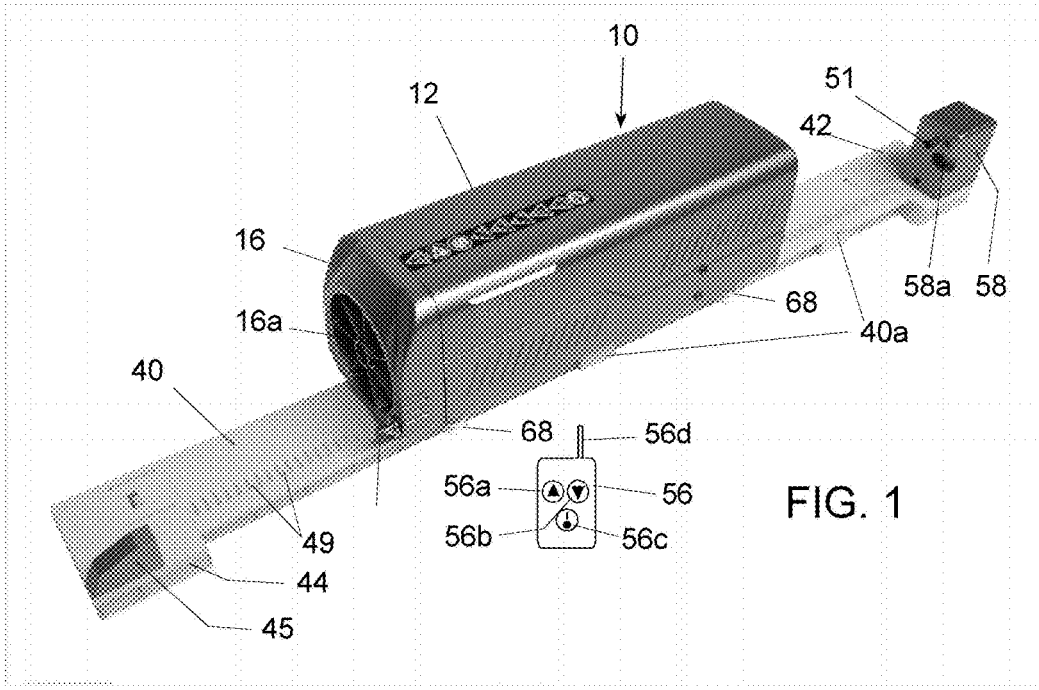
FIG. 1 is a front top perspective view of the self propelled blower apparatus of the invention including a shortened version of the guide track of the apparatus, and after the charged blower of the apparatus has left its power station and is progressing along the track.
Figure 2:
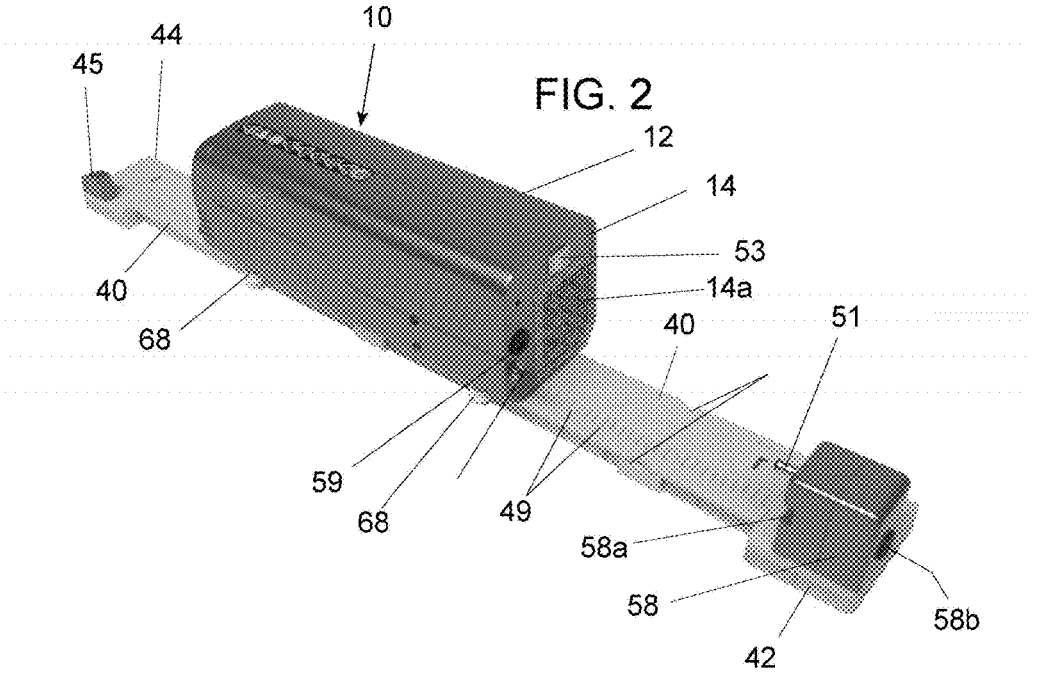
FIG. 2 is view similar to FIG. 1, taken from the rear.
Figure 3:
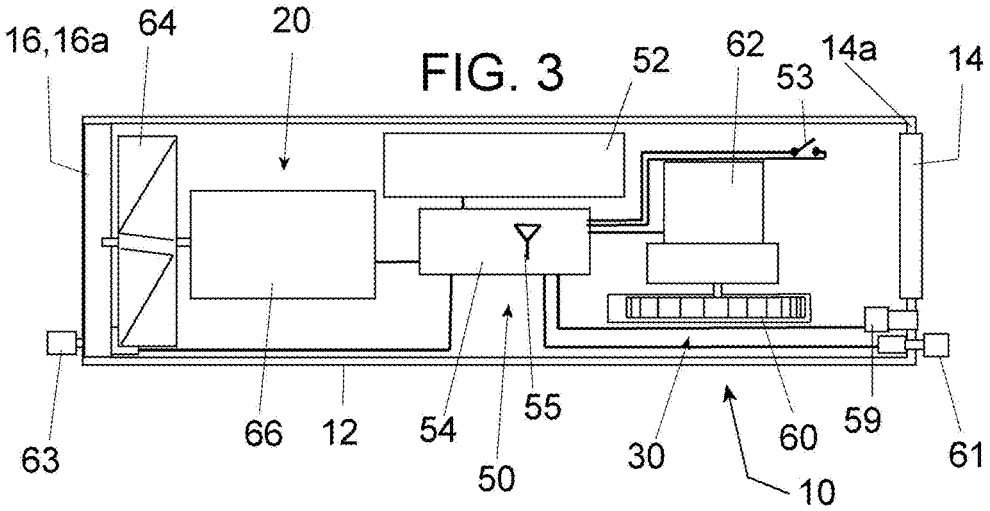
FIG. 3 is schematic sectional view of the blower.
Figure 5:
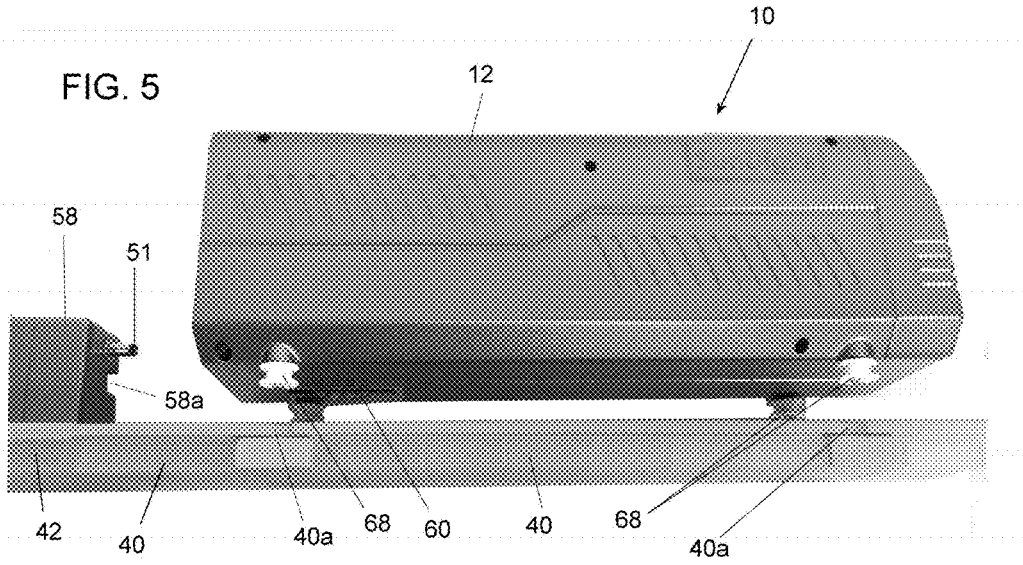
FIG. 5 is side view of the blower of the invention before it is engaged with the guide track of the invention.
Figure 6:
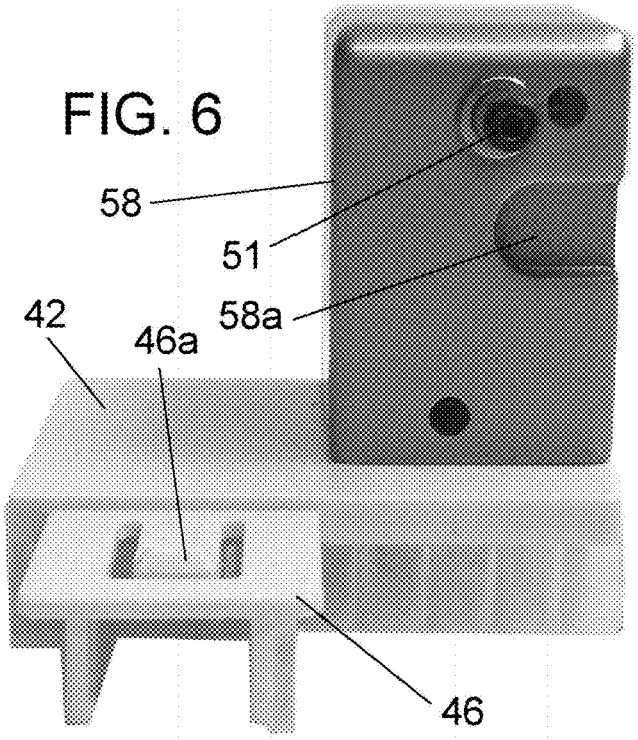
FIG. 6 is rearwardly looking side perspective view of the power station and section of a guide track of the invention.
Figure 7:
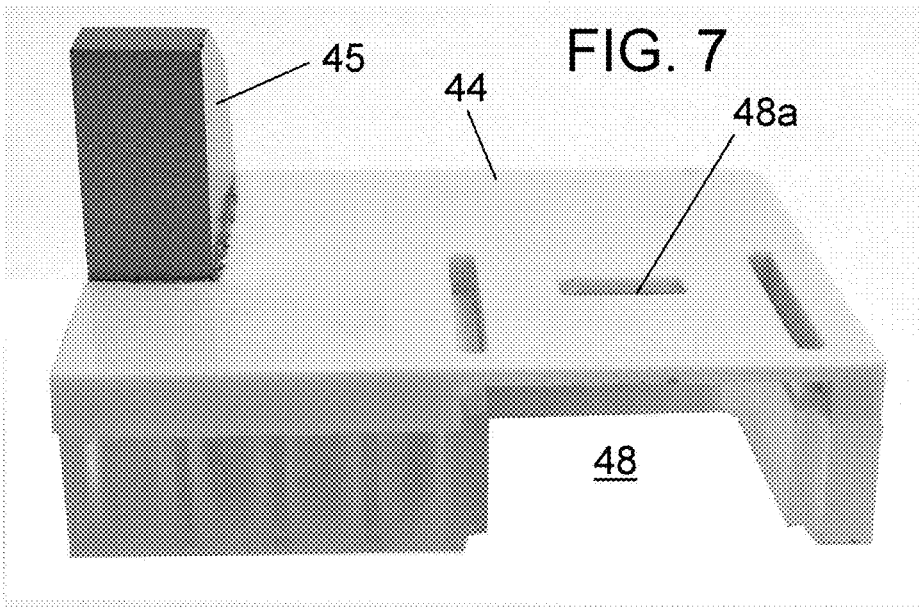
FIG. 7 is forwardly looking side perspective view of the stop section of the guide track of the invention.

Turning to FIGS. 3 and 5, the housing mover 30 includes a toothed cog wheel 60 that is connected to and is slowly rotated by a motor plus gear train combination 62 mounted in the housing 12. A cord segment of the cog wheel 60 extends down through a slot in the floor of the housing 12 to mesh with the recesses teeth 49. This is done when four side rollers 68, mounted for free rotation on four vertical shafts extending below the housing floor, are aligned with four circular roller notches 40*a* that are in a pair of horizontal side rails on opposite sides of the first track section of track 40, connected to power section 42, and the blower housing is lowered only the guide track 40, from a raised position shown in FIG. 5, to the track engaged position shown in FIGS. 1, 2 and 4. In this track engaging position, the grooves around rollers 68 embrace the side rails of the track 40 to positively hold the blower housing to the track as it moves along the track.

The notches 40*a* are spaced from the power station 58 so that the blower 10 can only be engaged to the track when it too is spaced from the power station to avoid an accidental disengagement of the blower from the track, for example, when the blower moves back to the power station to automatically plug its power coupler 59 in the charge coupler 51.

To install the apparatus, once all sections of the guide track 40 are connected, the track is laid into the bottom of the gutter channel 100 to be kept clean. The blower 10 is engaged to the track and wire from cell or cells 57 is plugged into the power intake receptacle 58*b*. It is advantageous to have previously charged the battery 52 by having plugged the power intake receptacle 58*b* into a wall-powered transformer with the blower 10 plugged into the power section 58, so that the blower has some power for an initial use at the gutter.

In the alternative or in addition to the solar cell or cells 57, the power station 58 can be connected to house current by a long wire up to the gutter.

To operate the apparatus of the invention the master switch 53 is closed. With this done, pressing the rearward button 56*b* of the remote control unit 56 will activate the air mover 20 to blow air only and always in the forward direction while activating the housing mover 30 to rotate the cog wheel 60 in reverse to move the blower toward the power station 58 as the teeth of the cog wheel engage along the recessed track teeth 49. This rearward movement continues until the stopping micro-switch 61 engages the rear stop surface 58*a* of the power station to press this switch and stop further rotation of the cog wheel. Surface 58*a* is placed so that this stopping action occurs only after power coupler 59 is plugged to charge coupler 51. The battery 52 is then charged for as long a sunlight shines on cell or cells 57, or via house current if used.

To use the apparatus to clean the gutter, forward button 56*a* on remote control unit 56 is pressed. This is done from the ground or even from inside the house. This action will activate the air mover 20 to start blowing cleansing air, and the housing mover 30 to rotate the cog wheel 60 in the forward direction to move the blower 10 forwardly away from the power station 58 and along the track 40, toward the stop section 44. This movement continues until the returning micro-switch 63 engages the stop 45 at which time the power circuit 54 reversed the rotation of motor/gear train 62 to reverse the movement of the blower, back toward the power station.

Air continues to be blown by air mover 20, to clean off any leaves or debris that may have been missed on the forward trip, until the blower reconnected with the power station 58 for a new charge cycle.

At any time a power button 56*c* on the remote control unit 56 can be pressed to stop the movement and blowing, and presses again to restart the movement either forwardly or backwardly.

While specific embodiments of the invention have been shown and described in detail to illustrate the application of the principles of the invention, it will be understood that the invention may be embodied otherwise without departing from such principles.

REFERENCE NUMBERS blower 10
housing 12 rear wall 14
rear air inlet opening 14*a*
front wall 16
front air outlet opening 16*a*
electrically powered air mover 20
electrically powered housing mover 30
guide track 40
roller notched 40*a*
power section 42
stop section 44
stop 45
tongue 46
tab 46*a*
groove 48
slot 48*a*
recessed teeth 49
power circuit 50
charge coupler 51
rechargeable battery 52
master switch 53
control circuit board 54
antenna 55
remote control unit 56
photovoltaic cells 57
power station 58
rear stop surface 58*a*
power intake receptacle 58*b*
power coupler 59
a cog wheel 60
stopping micro-switch 61
cog wheel motor 62
returning micro-switch 63
propeller 64
propeller motor 66
side rollers 68
concave gutter channel 100
building roof 110

What is claimed is:

1. A self propelled blower apparatus for cleaning debris from a gutter having a channel (100) for collecting and guiding water from a roof (110), the apparatus comprising:

a housing (12) having a rear wall (14) with a rear air inlet opening (14*a*) and a front wall (16) with front air outlet opening (16*a*);

an electrically powered air mover (20) in the housing (12) for moving air into the housing through the rear air inlet opening (14*a*) and blowing the air out of the housing through the front air outlet opening (16*a*) when powered;

a guide track (40) adapted to lay along a channel of a gutter; an electrically powered housing mover (30) mounted in the housing and engaged to the guide track for moving the housing along the guide track when powered; and a power circuit (50) electrically connected to the air and housing movers for powering the air and housing movers at the same time to blow air forwardly along the gutter as the housing moves forwardly along the track, the power station including at least one rechargeable battery (52) for powering the movers (20, 30).

2. The apparatus of claim 1, including a remote control unit (56) for activating the air and housing movers (20, 30).

3. The apparatus of claim 1, including a power station (58) at a rear end of the track to which the power circuit (50) is automatically electrically connected when the housing mover (30) moves the housing rearwardly against the power station (58) to recharge the at least one battery (52).

4. The apparatus of claim 1, including a power station (58) at a rear end of the track to which the power circuit (50) is automatically electrically connected when the housing mover (30) moves the housing rearwardly against the power station (58), and at least one photovoltaic cell (57) connected to the power station (58) for recharging the at least one battery (52).

5. The apparatus of claim 1, including a power station (58) at a rear end of the track to which the power circuit (50) is automatically electrically connected when the housing mover (30) moves the housing rearwardly against the power station (58), and a stop section (44) connected to a forward end of the track and having a stop (45) engageable with the housing (12) for reversing operation of the housing mover (30) to return the housing toward the power station (58).

6. The apparatus of claim 1, including a power station (58) at a rear end of the track to which the power circuit (50) is automatically electrically connected when the housing mover (30) moves the housing rearwardly against the power station (58), at least one photovoltaic cell (57) connected to the power station (58) for recharging the at least one battery (52), and a stop section (44) connected to a forward end of the track and having a stop (45) engageable with the housing (12) for reversing operation of the housing mover (30) to return the housing toward the power station (58).

7. The apparatus of claim 1, wherein the power circuit (52) includes a stopping micro-switch (61) at a rearward end of the housing (12) and returning micro-switch (63) at a forward end of the housing (12), the apparatus including a power station (58) at a rear end of the track to which the power circuit (50) is automatically electrically connected when the housing mover (30) moves the housing rearwardly against the power station (58) to engage the stopping micro-switch (61) to stop further rearward movement of the housing, at least one photovoltaic cell (57) connected to the power station (58) for recharging the at least one battery (52), and a stop section (44) connected to a forward end of the track and having a stop (45) engageable with the returning micro-switch (63) for reversing operation of the housing mover (30) to return the housing toward the power station (58).

8. The apparatus of claim 1, wherein the guide track (40) has a row of teeth (49), the housing mover (30) including a cog wheel (60) engaged with the teeth and rotatable to move the housing (12) along the track.

9. The apparatus of claim 1, wherein the power circuit (52) includes a stopping micro-switch (61) at a rearward end of the housing (12) and returning micro-switch (63) at a forward end of the housing (12), the apparatus including a power station (58) at a rear end of the track to which the power circuit (50) is automatically electrically connected when the housing mover (30) moves the housing rearwardly against the power station (58) to engage the stopping micro-switch (61) to stop further rearward movement of the housing, at least one photovoltaic cell (57) connected to the power station (58) for recharging the at least one battery (52), and a stop section (44) connected to a forward end of the track and having a stop (45) engageable with the returning micro-switch (63) for reversing operation of the housing mover (30) to return the housing toward the power station (58), the guide track (40) having a row of teeth (49), the housing mover (30) including a cog wheel (60) engaged with the teeth and rotatable to move the housing (12) along the track.

10. A self propelled blower apparatus for cleaning debris from a gutter comprising: a housing with rear inlet and a front outlet; an electrically powered air mover for moving air into the inlet and blowing air out of the outlet; a guide track laying along a channel of the gutter; an electrically powered housing mover engaged to the track for moving the housing along the guide track; and a power circuit electrically connected to the air and housing movers for powering them at the same time to blow air forwardly along the gutter as the housing moves forwardly along the gutter.

11. The apparatus of claim 10, including a remote control unit for activating the air and housing movers.

12. The apparatus of claim 10, including a power station at a rear end of the track to which the power circuit is automatically electrically connected when the housing mover moves the housing rearwardly against the power station, the power circuit including a rechargeable battery for powering the movers.

13. The apparatus of claim 10, including a power station at a rear end of the track to which the power circuit is automatically electrically connected when the housing mover moves the housing rearwardly against the power station, the power circuit including a rechargeable battery for powering the movers and the least one photovoltaic cell connected to the power station for recharging the at least one battery.

14. The apparatus of claim 10, including a power station at a rear end of the track to which the power circuit is automatically electrically connected when the housing mover moves the housing rearwardly against the power station, and a stop section connected to a forward end of the track and having a stop engageable with the housing for reversing operation of the housing mover to return the housing toward the power station.

15. The apparatus of claim 10, including a power station at a rear end of the track to which the power circuit is automatically electrically connected when the housing mover moves the housing rearwardly against the power station, at least one photovoltaic cell connected to the power station for recharging at least one battery in the power circuit, and a stop section connected to a forward end of the track and having a stop engageable with the housing for reversing operation of the housing mover to move the housing toward the power station.

16. The apparatus of claim 10, wherein the power circuit includes at least one rechargeable battery, a stopping micro-switch at a rearward end of the housing and returning micro-switch at a forward end of the housing, the apparatus including a power station at a rear end of the track to which the power circuit is automatically electrically connected when the housing mover moves the housing rearwardly against the power station to engage the stopping micro-switch to stop further rearward movement of the housing, at least one photovoltaic cell connected to the power station for recharging the at least one battery, and a stop section connected to a forward end of the track and having a stop engageable with the returning micro-switch for reversing operation of the housing mover to return the housing toward the power station.

17. The apparatus of claim 10, wherein the guide track has a row of teeth, the housing mover including a cog wheel engaged with the teeth and rotatable to move the housing along the track.

18. The apparatus of claim 10, wherein the power circuit includes at least one rechargeable battery, a stopping micro-switch at a rearward end of the housing and returning micro-switch at a forward end of the housing, the apparatus including a power station at a rear end of the track to which the power circuit is automatically electrically connected when the housing mover moves the housing rearwardly against the power station to engage the stopping micro-switch to stop further rearward movement of the housing, at least one photovoltaic cell connected to the power station for recharging the at least one battery, and a stop section connected to a forward end of the track and having a stop engageable with the returning micro-switch for reversing operation of the housing mover to return the housing toward the power station, the guide track having a row of teeth, the housing mover including a cog wheel engaged with the teeth and rotatable to move the housing along the track.

* * * * *